US009181600B2

(12) United States Patent
Katsumata

(10) Patent No.: US 9,181,600 B2
(45) Date of Patent: Nov. 10, 2015

(54) HEAT TREATMENT APPARATUS AND HEAT TREATMENT METHOD

(75) Inventor: Kazuhiko Katsumata, Kakamigahara (JP)

(73) Assignee: IHI CORPORATION (JP)

( * ) Notice: Subject to any disclaimer, the term of this patent is extended or adjusted under 35 U.S.C. 154(b) by 537 days.

(21) Appl. No.: 13/145,841

(22) PCT Filed: Dec. 25, 2009

(86) PCT No.: PCT/JP2009/007271

§ 371 (c)(1),
(2), (4) Date: Jul. 22, 2011

(87) PCT Pub. No.: WO2010/092659

PCT Pub. Date: Aug. 19, 2010

(65) Prior Publication Data

US 2011/0275024 A1 Nov. 10, 2011

(30) Foreign Application Priority Data

Feb. 10, 2009 (JP) ..... P2009-028900
Feb. 27, 2009 (JP) ..... P2009-047227

(51) Int. Cl.

| | |
|---|---|
| ***F27D 15/02*** | (2006.01) |
| ***C21D 11/00*** | (2006.01) |
| ***C21D 1/00*** | (2006.01) |
| ***C21D 1/667*** | (2006.01) |
| ***C21D 1/74*** | (2006.01) |

(Continued)

(52) U.S. Cl.

CPC ..... *C21D 11/005* (2013.01); *C21D 1/00* (2013.01); *C21D 1/667* (2013.01); *C21D 1/74* (2013.01); *F27B 9/02* (2013.01); *F27B 9/12* (2013.01)

(58) Field of Classification Search

CPC ..... F27B 9/042; F27B 5/04
USPC ..... 432/42, 77, 85, 48, 78, 82
See application file for complete search history.

(56) References Cited

U.S. PATENT DOCUMENTS 3,918,891 A * 11/1975 Theil ..... 432/18
5,458,485 A * 10/1995 Righetti ..... 432/78

(Continued)

FOREIGN PATENT DOCUMENTS

DE 10 2007 029 038 A1 1/2009
JP 55-065318 5/1980

(Continued)

OTHER PUBLICATIONS

Office Action dated Dec. 18, 2012 issued in corresponding German Patent Application No. 11 2009 004 328.3 with English translation (8 pages).

(Continued)

*Primary Examiner* — Steven B McAllister
*Assistant Examiner* — Ko-Wei Lin
(74) *Attorney, Agent, or Firm* — Ostrolenk Faber LLP

(57) ABSTRACT

The present invention relates to a heat treatment apparatus and a heat treatment method that control temperature distribution during cooling. There is provided a cooling step in which a heated treatment object is cooled using a cooling liquid in mist form, and heat treatment is performed by alternatingly repeating a first step (K1) in which the treatment object is cooled at a first mist density, and a second step (K2) in which the treatment object is cooled at a second mist density that is less dense than the first mist density.

8 Claims, 6 Drawing Sheets

(51) Int. Cl.
*F27B 9/02* (2006.01)
*F27B 9/12* (2006.01)

(56) References Cited

U.S. PATENT DOCUMENTS

| | | | | |
|---|---|---|---|---|
| 6,889,763 | B1 * | 5/2005 | Subramanian et al. | 165/244 |
| 7,690,211 | B2 * | 4/2010 | Sakurai et al. | 62/197 |
| 2008/0289811 | A1 * | 11/2008 | Kariya | 165/300 |

FOREIGN PATENT DOCUMENTS

| | | | | | |
|---|---|---|---|---|---|
| JP | 58-141323 | | | 8/1983 | |
| JP | 10-216827 | | | 8/1998 | |
| JP | 10216827 | A | * | 8/1998 | B21B 45/02 |
| JP | 11-153386 | | | 6/1999 | |
| JP | 2000-313920 | | | 11/2000 | |
| JP | 2000313920 | A | * | 11/2000 | C21D 9/52 |

OTHER PUBLICATIONS

International Search Report and Written Opinion mailed Apr. 6, 2010 in corresponding PCT International Application No. PCT/JP2009/007271.

* cited by examiner

HEAT TREATMENT APPARATUS AND HEAT TREATMENT METHOD

CROSS-REFERENCE TO RELATED APPLICATIONS

The present application is a 35 U.S.C. §§371 national phase conversion of PCT/JP2009/007271, filed Dec. 25, 2009, which claims priority of Japanese Patent Application Nos. 2009-028900 and 2009-047227, filed Feb. 10, 2009 and Feb. 27, 2009, respectively, the contents of which are incorporated herein by reference. The PCT International Application was published in the Japanese language.

TECHNICAL FIELD

The present invention relates to a heat treatment apparatus and a heat treatment method, and to a heat treatment apparatus that is preferable for use in such processing as, for example, the quenching of a treatment object.

TECHNICAL BACKGROUND

Conventionally, an oil quenching type of cooling apparatus or a gas quenching type of cooling apparatus is used in cases in which high-speed cooling is required in a heat processing apparatus that performs processing such as quenching in which a treatment object in the form of a metal material is heated and then cooled. These oil quenching cooling apparatuses have superior cooling efficiency, however, they have the problem that they are substantially unable to perform precise cooling control and it is easy for an article being heat-treated to become deformed. In contrast, in gas quenching cooling apparatuses, although cooling control is easily achieved by controlling the gas flow rate so that these apparatuses less likely deform the article being heat-treated, they have the problem that they have inferior cooling efficiency.

Consequently, a technology is disclosed in Patent document 1 in which liquid nozzles and gas nozzles are disposed around an article being heat-treated, and cooling liquid is supplied as a spray from the liquid nozzles (what is known as mist cooling), while cooling gas is supplied from the gas nozzles. As a result, an improvement is achieved in both cooling controllability and cooling efficiency.

DOCUMENTS OF THE PRIOR ART

Patent Documents

[Patent document 1] Japanese Patent Application Laid-Open (JP-A) No. 11-153386

DISCLOSURE OF THE INVENTION

Problems to be Solved by the Invention

If the mist density becomes unevenly distributed inside the cooling chamber, then differences arise in the cooling performance and there is a possibility that a temperature distribution will be generated in the treatment object. Moreover, when there is a plurality of objects being treated, there is a possibility that temperature differences will arise between treatment objects corresponding to the distribution of the mist density.

If a temperature distribution is generated in treatment objects in this manner, then not only is there a possibility that this will cause deformation in the treatment objects, but if treatment objects in which a temperature distribution has been generated are used in quenching processing, there is also a possibility that these treatment objects will not have a uniform hardness.

If, on the other hand, temperature differences are generated in a plurality of treatment objects, then differences arise in the qualities of the respective treatment objects, and there is a possibility that this will cause defects in quality.

The present invention was conceived in consideration of the above points, and it is an object thereof to provide a heat treatment apparatus and heat treatment method that make it possible to control temperature distribution during cooling.

Means for Solving the Problem

The present invention employs the following structure in order to achieve the above object.

(1) The heat treatment method of the present invention is a heat treatment method having a cooling step in which a heated treatment object is cooled using a cooling liquid in mist form, wherein a first step in which the treatment object is cooled at a first mist density, and a second step in which the treatment object is cooled at a second mist density that is less dense than the first mist density are repeated alternatingly.

Accordingly, in the heat treatment method of the present invention, even if a temperature distribution is generated in a treatment object in the first step, because the mist density is less in the second step, any expansion of the temperature distribution caused by this mist cooling is suppressed, and the temperature distribution is alleviated by heat conduction in the treatment object. Accordingly, in the present invention, it is possible to control temperature distribution during cooling in a treatment object, and it is possible to avoid the occurrence of quality defects such as deformation and unevenness in hardness.

(2) In the heat treatment method described above in (1), it is also possible for the cooling liquid in mist form to be supplied in the first step, and for the supplying of the cooling liquid in mist form to be stopped in the second step.

By employing this type of structure, in the present invention, it is possible in the second step to effectively promote the alleviation of temperature distribution by means of heat conduction in the treatment object.

(3) In the heat treatment method described above in (1) or (2), it is also possible for the density of the cooling liquid mist to be adjusted using at least one of the supply quantity, supply pressure, and supply time of the cooling liquid.

(4) In the heat treatment method described above in (1) through (3), it is also possible for correlations between the supply state of the cooling liquid mist and the temperature characteristics of the treatment object to be stored, and, based on these correlations, for the treatment to switch between the first step and the second step.

By employing this type of structure, in the present invention, it is possible to implement open control which switches between the first step and the second step based on correlations stored in advance, and to consequently perform heat treatment both efficiently and extremely accurately.

(5) In the heat treatment method described above in (1) through (4), it is also possible for there to be provided: a step in which the temperature of the treatment object is measured; and a step in which the supplying of the cooling liquid mist is controlled based on the measured temperature.

By employing this type of structure, in the present invention, by adjusting the supply quantity, the supply pressure, and the supply time of the cooling liquid mist in accordance with the temperature of the treatment object, it becomes possible to perform the optimum cooling treatment, and to achieve highly accurate heat treatment for a treatment object.

(6) In the heat treatment method described above in (5), it is also possible for the temperature of the treatment object to be measured in a plurality of locations, and, based on temperature differences in the measured treatment object, for the treatment to switch between the first step and the second step.

By employing this type of structure, in the present invention, after temperature differences in a treatment object have exceeded a predetermined threshold value, it is possible to suppress any enlargement of the temperature difference by switching from the first step to the second step, and after the temperature difference in the treatment object has been reduced by heat conduction to less than the threshold value, the cooling treatment of the treatment object can be performed by switching from the second step to the first step.

(7) In the heat treatment method described above in (5), it is also possible for the temperature to be measured in a plurality of the treatment objects when there is the plurality of treatment objects, and, based on temperature differences between the measured treatment objects, for the treatment to switch between the first step and the second step.

By employing this type of structure, in the present invention, it is possible to control temperature differences between the plurality of treatment objects, and to suppress the occurrence of quality defects in each treatment object.

Furthermore, the heat treatment apparatus of the present invention is a heat treatment apparatus that supplies cooling liquid in mist form to a cooling chamber, and cools a heated treatment object, wherein the heat treatment apparatus is provided with a switching apparatus that switches the supply of the cooling liquid mist alternatingly between a first mist density and a second mist density that is less than the first mist density.

Accordingly, in the heat treatment apparatus of the present invention, even if a temperature distribution is generated in a treatment object as a result of the heat treatment apparatus supplying cooling liquid at a first mist density, by supplying cooling liquid at a second mist density that is less dense than the first mist density, any expansion of the temperature distribution caused by this mist cooling is suppressed, and the temperature distribution is alleviated by heat conduction in the treatment object. Accordingly, in the present invention, it is possible to control temperature distribution during cooling in a treatment object, and it is possible to avoid the occurrence of quality defects such as deformation and unevenness in hardness.

Effects of the Invention

In the present invention it is possible to control temperature distribution during cooling in an object being treated, and it is possible to avoid the creation of quality defects such as deformation and unevenness in hardness.

BEST EMBODIMENTS FOR IMPLEMENTING THE INVENTION

Hereinafter, an embodiment of the heat treatment apparatus and heat treatment method of the present invention will be described with reference made to FIG. 1 through FIG. 6.

Note that in the respective drawings used in the following description, the scale of each component has been suitably modified in order to make each component a recognizable size.

Moreover, in the present embodiment a multi-chamber type of vacuum heat treatment furnace (hereinafter, this is referred to simply as a 'vacuum heat treatment furnace') is used as an example of a heat treatment apparatus.

Figure 1:
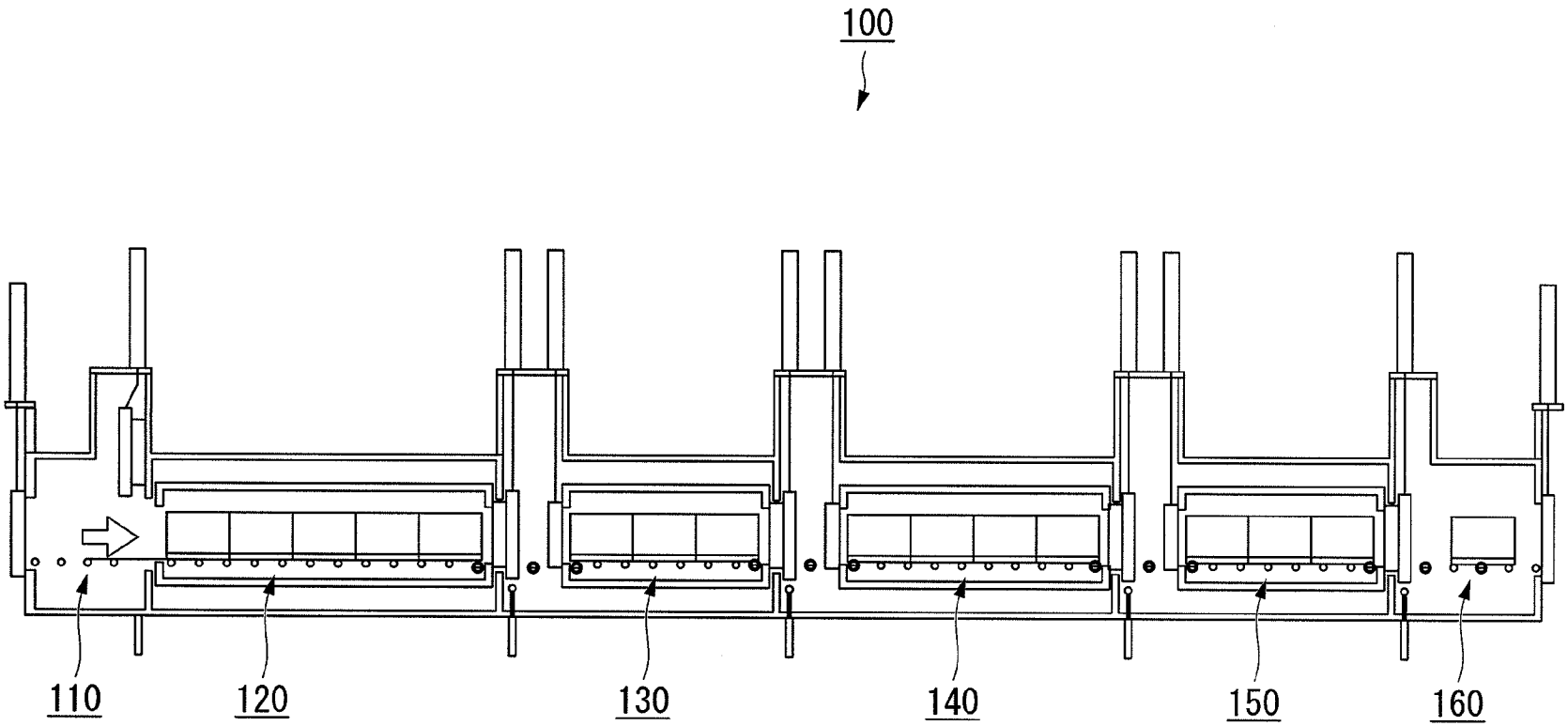
FIG. 1 is a view of the overall structure of a vacuum heat treatment furnace of the present embodiment.

FIG. 1 is a view of the overall structure of the vacuum heat treatment furnace of the present embodiment.

A vacuum heat treatment furnace (heat treatment apparatus) 100 performs heat treatment on an object being treated, and is provided with a deaeration chamber 110, a preliminary heating chamber 120, a carburizing chamber 130, a diffusion chamber 140, a temperature reduction chamber 150, and a cooling chamber 160 which are disposed adjacent to each other in this sequence. Treatment objects are transported in a single line sequentially through the respective chambers 110 through 160.

Because the feature of the present invention lies in the cooling treatment in the cooling chamber 160, hereinafter, the cooling chamber 160 will be described in detail.

Figure 2:
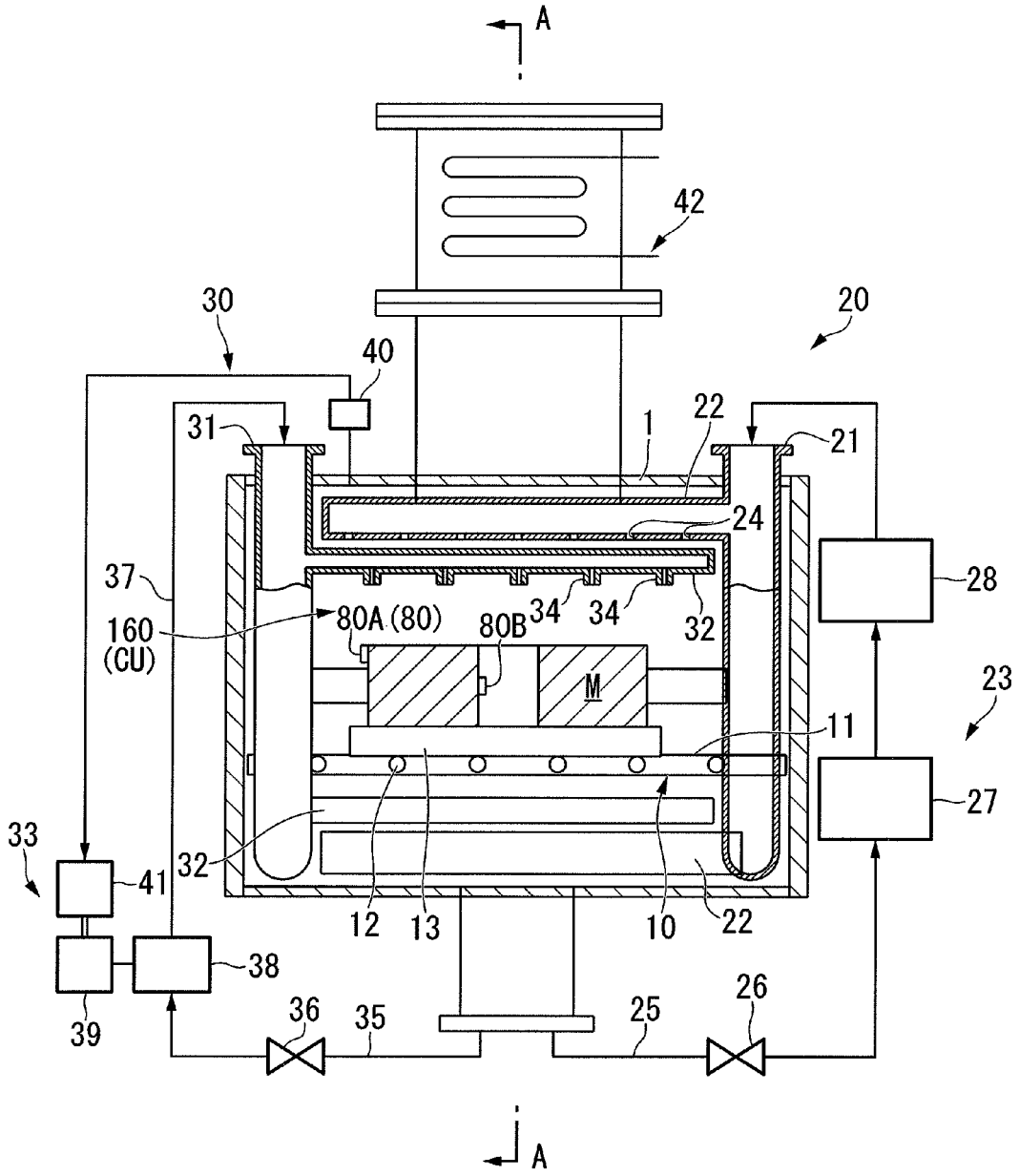
FIG. 2 is a front cross-sectional view of a cooling chamber.
Figure 3:
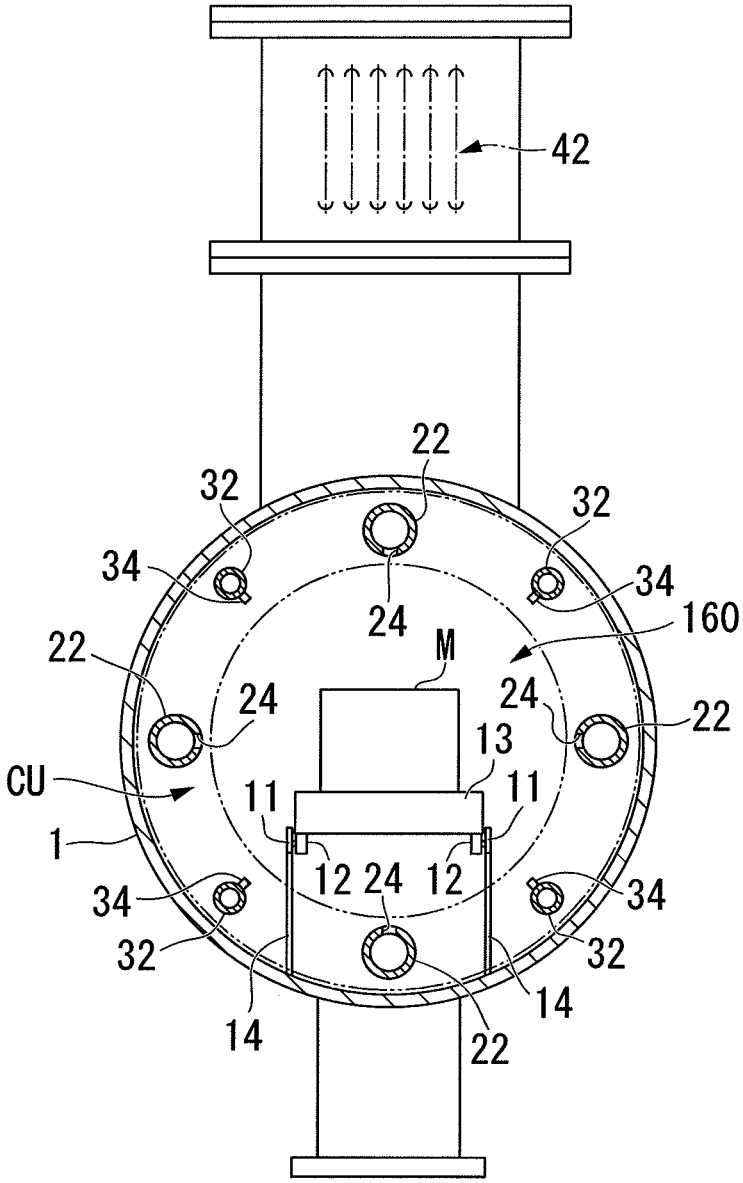
FIG. 3 is a cross-sectional view taken along a line A-A in FIG. 2.

FIG. 2 is a front cross-sectional view of the cooling chamber 160, and FIG. 3 is a cross-sectional view taken along a line A-A in FIG. 2. The cooling chamber 160 is formed inside a vacuum vessel 1. In addition, a cooling unit CU which includes a transporting apparatus 10, a gas cooling apparatus 20, a mist cooling apparatus 30, and a temperature measurement apparatus 80 is also provided within the vacuum vessel 1.

The transporting apparatus 10 is able to transport a treatment object M in a horizontal direction, and has: a pair of support frames 11 that are disposed facing each other at a distance, and that extend in the transporting direction (i.e., a horizontal direction); rollers 12 that are provided at predetermined distances from each other in the transporting direction on the mutually facing surfaces of the respective support frames 11 such that they are able to rotate freely; a tray 13 on which the treatment object M is placed and which is transported over the rollers 12; and a support frame 14 (not shown in FIG. 2) that is provided in a vertical direction and supports both ends of the support frames 11.

Note that, in the description given below, the direction in which the treatment object M is transported by the transporting apparatus 10 is referred to as simply as the 'transporting direction'.

The tray 13 is substantially a rectangular parallelepiped, and is formed by arranging, for example, plate materials in a lattice shape. The width of the tray 13 is slightly larger than the width of the treatment object M, and its size is such that it is supported by the rollers 12 via the edges in the width direction of its bottom surface. Here, a ring-shaped object having a space formed in a center portion thereof is illustrated as an example of the treatment object M.

The gas cooling apparatus 20 cools the treatment object M by supplying cooling gas to the interior of the cooling chamber 160, and is provided with a header pipe 21, a supply pipe 22, and a gas recovery and supply system 23. As is shown by the double dot chain line in FIG. 3, the header pipe 21 is disposed at an end portion on the downstream side in the transporting direction of the cooling chamber 160, and is formed in a toroidal shape which is centered on the transporting path along which the treatment object M is transported by the transporting apparatus 10. Cooling gas is supplied to this header pipe 21 by the gas recovery and supply system 23.

One end portion of the supply pipe 22 is connected to the header pipe 21, while the other end side thereof is formed so as to extend in a horizontal direction towards the upstream side in the transporting direction, and a plurality (four in this case) of the supply pipes 22 are provided at substantially equal intervals (at 90° intervals in this case) in the circumferential direction centered on the transporting path along which the treatment object M is transported by the transporting apparatus 10. Specifically, as is shown in FIG. 3, the supply pipes 22 are provided at the 3 o'clock, 6 o'clock, 9 o'clock, and 12 o'clock positions (i.e., at the top, bottom, left, and right positions) of the toroidal header pipe 21. Each supply pipe 22 is formed such that the other end side thereof extends in a horizontal direction towards the upstream side in the transporting direction of the cooling chamber 160, and is long enough to extend over the length of the cooling chamber 160. In each supply pipe 22, a plurality of jet nozzles 24 that face towards the transporting path of the treatment objects are formed at predetermined distances from each other and extending over the entire length direction of the supply pipes 22.

The gas recovery and supply system 23 includes an gas exhaust pipe 25 that is connected to the vacuum vessel 1, a shut-off valve 26 that is provided on the air exhaust pipe 25, a heat exchanger 27 that functions as a cooler to re-cool cooling gas recovered in the air exhaust pipe 25, and a fan 28 that supplies the re-cooled cooling gas to the header pipe 21.

Examples of cooling gases that may be used include inert gases such as argon, helium, nitrogen, and the like.

The mist cooling apparatus 30 cools the treatment object M by supplying cooling liquid in a mist form to the interior of the cooling chamber 160 and is provided with a header pipe 31 (not shown in FIG. 3), supply pipes 32, and a cooling liquid recovery and supply system 33. The header pipe 31 is disposed at an end portion on the upstream side in the transporting direction of the cooling chamber 160, and is formed in a toroidal shape which is centered on the transporting path along which the treatment object M is transported by the transporting apparatus 10. Cooling liquid is supplied to this header pipe 31 by the cooling recovery and supply system 33.

One end portion of the supply pipe 32 is connected to the header pipe 31, while the other end side thereof is formed so as to extend in a horizontal direction towards the downstream side in the transporting direction. In addition, a plurality (four in this case) of the supply pipes 32 are provided at substantially equal intervals (at 90° intervals in this case) in the circumferential direction centered on the transporting path along which the treatment object M is transported by the transporting apparatus 10. Specifically, as is shown in FIG. 3, the supply pipes 32 are provided at positions ±45° from a horizontal direction in the toroidal header pipe 21. Each supply pipe 32 is formed such that the other end side thereof extends in a horizontal direction towards the downstream side in the transporting direction of the cooling chamber 160, and is long enough to extend over the length of the cooling chamber 160. In each supply pipe 32, a plurality of nozzle portions 34 that spray cooling liquid in mist form towards the transporting path of the treatment objects are formed at predetermined distances from each other and extending over the entire length direction of the supply pipes 32.

Note that the supply pipes 32 and the nozzle portions 34 are preferably not aligned in a vertical direction where there is a possibility that variations in the supply quantities will occur due to the cooling liquid mist being affected by gravity, and it is ideal if the cooling liquid mist is supplied in a horizontal direction. However, if the cooling liquid is supplied from a vertical direction, then consideration should be given to the effects of gravity and the supply quantities adjusted accordingly. Moreover, if, for example, three supply pipes 32 are provided instead of four, then it is preferable to position one pipe at the zenith point and the other two pipes at positions of ±120° from this zenith point in order to minimize the vertical component as much as possible.

The cooling liquid recovery and supply system 33 includes a liquid discharge pipe 35 that is connected to the vacuum vessel 1, a shut-off valve 36 that is provided on the liquid discharge pipe 35, a pump 38 that feeds cooling liquid recovered by the liquid discharge pipe 35 via a piping system 37 to the header pipe 31 using the driving of a motor 39, a sensor 40 that measures the pressure (i.e., air pressure) inside the cooling chamber 160, an inverter 41 that functions as a cooling liquid flow rate controller that controls the driving of the motor 39 based on measurement results from the sensor 40, and a liquefier (i.e., a liquefaction trap) that liquefies cooling liquid which has been vaporized by heat received from treated articles.

Examples of cooling liquids that may be used include oil, salt, and fluorine-based inert liquids (described below), and the like.

The temperature measurement apparatus 80 measures the temperature of treatment objects M, and includes a temperature sensor 80A which is provided at an outer circumference of the treatment object M, and a temperature sensor 80B which is provided in the center of the inner circumference of the treatment object M. Measurement results from the temperature sensors 80A and 80B are output to the inverter 41. Here, thermocouples are provided as the temperature sensors 80A and 80B, however, it is also possible to measure a plurality of locations using, for example, non-contact-type sensors such as radiation thermometers.

The inverter 41 controls the driving of the motor 39 in accordance with measurement results from the temperature sensors 80A and 80B.

Next, a procedure to cool a heated treatment object M in the cooling chamber 160 in the above described vacuum heat treatment furnace 100 will be described.

Cooling liquid is supplied by being sprayed in mist form from the nozzle portions 34 of the mist cooling apparatus 30 onto a treatment object M which has been transported into the cooling chamber 160. Here, as is shown in FIG. 3, for example, as a result of the angle of diffusion from the nozzle portions 34 being set to 90°, it is possible to spray the entire side surface (i.e., outer circumferential surface) of the treatment object M. Moreover, at this time, because the tray 13 is formed by arranging plate materials in a lattice pattern, the cooling liquid which is sprayed from the nozzle portions 34 positioned diagonally downwards from the treatment object M (i.e., the tray 13) passes through the gaps between the plate materials, and is able to reach the treatment object M unobstructed and cool the treatment object M. In addition, because the nozzle portions 34 are provided extending over the entire lengthwise direction of the cooling chamber 160, the front surface and rear surface in the transporting direction of the treatment object M are supplied with the cooling liquid in mist form at a predetermined mist density (a first mist density) by being sprayed in particular from the nozzle portions 34 positioned at both end sides of the supply pipe 32. As a result, it is possible to cool the treatment object M without any obstruction from the latent heat of vaporization of the cooling liquid in mist form (first step: shown by the symbol K1 in FIG. 5).

Here, because the mist density in the cooling chamber 160 is not uniform, but becomes distributed by the placement of the nozzle portions 34 and the like, differences occur in the cooling performance with which the treatment object M is cooled. In particular, as in the treatment object M in the present embodiment, when a space is foamed in a center portion, differences are created in the cooling performance which are caused by differences in mist density between the vicinity of the outer circumferential portions and the vicinity of the inner circumferential portions, and this results in temperature differences.

Figure 4:
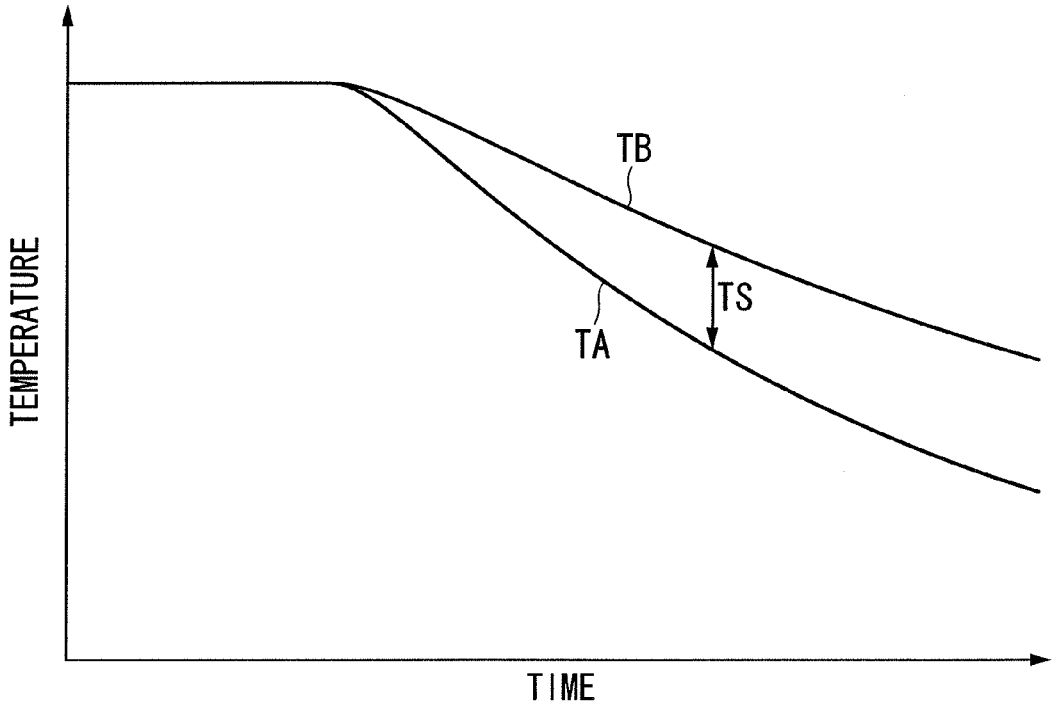
FIG. 4 is a view showing a relationship between time and temperature when mist cooling is performed.

For example, as is shown in FIG. 4, because the temperature reduction is more rapid for a temperature TA of those locations where there is a high mist density and a superior cooling efficiency than for a temperature TB of those locations where there is a low mist density and an inferior cooling efficiency, a temperature difference TS becomes larger over time.

Because of this, in the present embodiment, the temperature sensors 80A and 80B are located respectively on the outer circumferential surface and the inner side of the inner circumferential surface of the treatment object M as it is predicted that these locations will provide the greatest difference in temperature.

When the temperature difference TS of the treatment object M which has been determined from measurement results from the temperature sensors 80A and 80B exceeds a predetermined threshold value (for example, 10° C.) (i.e., at the time T1), the inverter 41 functions as a switching device and controls the driving of the motor 39 such that the supply of mist from the nozzle portions 34 of the mist cooling apparatus 30 is stopped.

Figure 5:
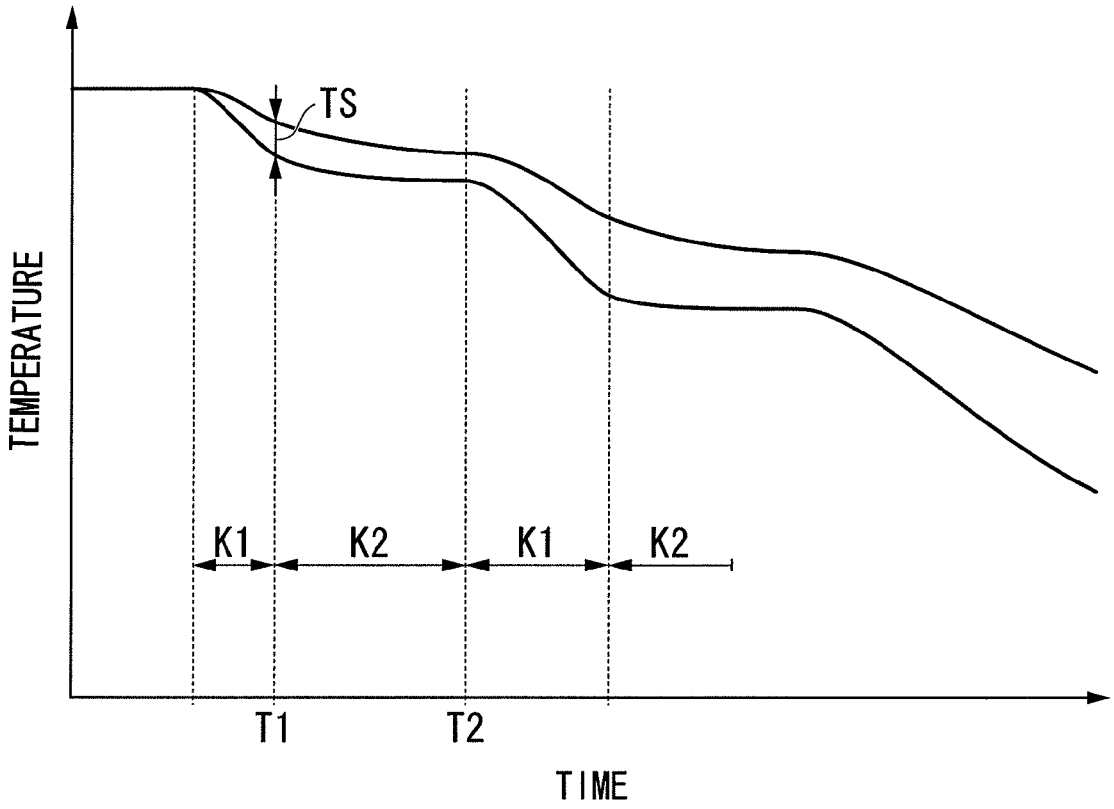
FIG. 5 is a view showing a relationship between time and temperature when a first step and a second step are repeated alternatingly.

As a result, the mist density in the cooling chamber 160, particularly in the vicinity of the outer circumference of the treatment object M decreases (to become a second mist density), and the treatment object M is cooled at a lower cooling efficiency than in the first step (second step: shown by the symbol K2 in FIG. 5). At this time, in the treatment object M, the temperature difference TS decreases as heat is transmitted from high temperature portions to low temperature portions due to heat conduction.

After the temperature difference TS has dropped to less than a predetermined threshold value (for example, 10° C.), cooling liquid in mist form is once again supplied from the nozzle portions 34 and sprayed into the cooling chamber 160. In this manner, predetermined threshold values are set and the first step and second step are repeated alternatingly until, using the measurement results from the temperature sensors 80A and 80B, the treatment object M is determined to have reached a predetermined temperature.

Here, it is possible to stop the mist supply or recommence the mist supply as soon as the respective threshold value is exceeded, however, in order to avoid a situation in which the motor 39 and pump 38 are repeatedly operated for short intervals so that the load becomes too large, it is preferable, for example, for the driving of the motor 39 and pump 38 to be started or stopped after a predetermined time (for example, 5 seconds) has elapsed after the threshold value has been exceeded.

Moreover, instead of setting a delay time, it is also possible to set a differential temperature (for example, 2° C.), and to stop the mist cooling when the temperature difference TS has exceeded 12° C., and then recommence the mist cooling when the temperature difference TS has dropped to less than 8° C.

During the supplying of the cooling liquid mist, treatment is preferably performed at less than atmospheric pressure from the standpoint of preventing leakages of cooling liquid from the vacuum vessel 1 during treatment. The cooling liquid desirably has the physical property that, at atmospheric pressure and at a normal temperature of 25° C., its boiling point is not less than that of water (i.e., a boiling point of not less than 100° C.). The reason for this is that, because the temperature of cooling liquid which has been sprayed as a mist rises as it exchanges heat with the treatment object M, a heat exchanger is used as a mechanism (i.e., the liquefier 42) to cool the cooling liquid, and water is generally used as the heat exchange medium.

More specifically, a method is typically employed in which, because the water which is serving as a heat exchange medium is cooled using a cooling tower, it is most suitably used between approximately 40 and 50° C. (namely, the temperature of the cooling liquid after heat exchange (i.e., the temperature at which the cooling liquid mist is supplied) is between approximately 40 and 50° C.) in consideration of the optimum heat exchange efficiency with the cooling liquid. Moreover, because the cooling liquid absorbs an amount of heat which corresponds to the difference between the boiling point thereof and the temperature of the treatment object M, if an even greater quantity of heat is to be absorbed, it is desirable for the cooling liquid to have a boiling point at a temperature approximately 30 to 50° C. higher than the temperature at which the cooling liquid mist is supplied. For these reasons, it is desirable for the boiling point of the cooling liquid to be not less than that of water (i.e., not less than 100° C.).

Specifically, if, for example, a fluorine-based inert liquid having a boiling point of 131° C. at a normal temperature of 25° C. is used at less than atmospheric pressure (101 kPa (abs)), then it is preferable for treatment to be performed under conditions ranging approximately between a controlled atmospheric pressure of 55 kPa (abs), at which the boiling point is 110° C., and a controlled atmospheric pressure of 20 kPa (abs), at which the boiling point is 80° C.

Moreover, because the cooling liquid absorbs a quantity of heat which corresponds to the difference between the boiling point of the cooling liquid and the temperature of the treatment object M, if consideration is given to suppressing any unevenness in the quantity of heat absorbed from the treatment object M, then it is desirable for the temperature difference between the temperature at which the cooling liquid mist is supplied and the boiling point of the cooling liquid to remain constant.

Specifically, if there is a reduction in the temperature at which the cooling liquid mist is supplied, then it is desirable for the controlled atmospheric pressure to be raised so that the boiling point of the cooling liquid is lowered by an amount corresponding to the size of the cooling mist temperature reduction. If, on the other hand, there is an increase in the temperature at which the cooling mist is supplied, then it is desirable for the controlled atmospheric pressure to be lowered so that the boiling point of the cooling liquid is raised by an amount corresponding to the size of the cooling mist temperature increase. Note that the controlled atmospheric pressure is lowered by expelling the gas inside the vessel using a vacuum expulsion apparatus (not shown).

Meanwhile, the cooling gas is supplied from the jet nozzles 24 in the gas cooling apparatus 20 and sprayed onto the treatment object M. The treatment object M is cooled directly by the sprayed cooling gas, and the cooling liquid which is sprayed in mist form into the cooling chamber 160 is diffused by the flow of the cooling gas. As a result, the atmosphere inside the cooling chamber 160 can be kept uniform.

In the case of cooling which utilizes this cooling liquid in mist form, it is possible to supply cooling liquid continuously and perform heat exchange with the treatment object M. Because of this, it is possible to perform continuous cooling treatment on a treatment object M, and there are no instances of drawbacks which occur when the treatment object M is immersed in cooling liquid such as a deterioration in cooling efficiency being generated by a reduction in the area of contact with the cooling liquid which is due to bubbles being generated by the boiling when the cooling liquid comes into contact with the high-temperature treatment object M, or such as the quantity of these bubbles further increasing so as to form a vapor film which then forms an insulating layer resulting in a marked reduction in the cooling efficiency.

The cooling liquid which is supplied in mist form to the cooling chamber 160 becomes liquefied on the inner wall surface of the vacuum vessel 1 and on the liquefier 42, and accumulates in the bottom portion of the vacuum vessel 1. By driving the motor 39 and operating the pump 38 when the shut-off valve 26 in the gas recovery and supply system 23 is closed and the shut-off valve 36 in the cooling liquid recovery and supply system 33 is open, the accumulated cooling liquid is supplied to the header pipe 31 such that it circulates via the piping system 37. In particular, if the sensor 40 detects that the air pressure inside the cooling chamber 160 has decreased so that the quantity of cooling liquid which is supplied and sprayed has also decreased, by controlling the driving of the motor 39 by means of the inverter 41 so as to adjust the quantity of cooling liquid that is supplied, it is possible to constantly supply the optimum quantity of cooling liquid to the header pipe 31.

Furthermore, cooling gas that is supplied to the cooling chamber 160 is also circulated and reused.

Specifically, by closing the shut-off valve 36 in the cooling liquid recovery and supply system 33 and opening the shut-off valve 26 in the gas recovery and supply system 23, cooling gas which has been introduced from the cooling chamber 160 into the gas exhaust pipe 25 is cooled once again in the heat exchanger 27, and can be supplied by the operation of the fan 28 so as to circulate to the header 21.

As has been described above, in the present embodiment, by repeating a first step in which a treatment object M is cooled at a first mist density alternatingly with a second step in which the treatment object M is cooled at a second mist density, it is possible to reduce a temperature difference TS in the treatment object M during cooling treatment. As a consequence, in the present embodiment, it is possible to suppress deformation in the treatment object M resulting from the cooling treatment, and to also suppress any variation in the hardness distribution in the treatment object M after heat treatment, and to accordingly provide a high-quality treatment object.

In particular, in the present embodiment, because the supplying of the cooling liquid mist is halted in the second step, the maximum density can be obtained between the first and second mist densities, and it becomes possible to more efficiently reduce the temperature difference TS in the treatment object M.

Moreover, in the present embodiment, because the temperature of the treatment object M is measured in a plurality of locations, more specifically, in locations having a superior cooling efficiency and locations having an inferior cooling efficiency, and the first step and second step are alternated in accordance with the results of such measurements, it is possible to perform heat treatment that provides high productivity based on automatic operation. Moreover, during quenching and the like, because it is possible to set a desired cooling curve (i.e., showing a relationship between time and temperature decrease characteristics), and to cool the treatment object M while conforming to this cooling curve, even if heat treatment such as quenching and the like is being performed on, for example, a steel material treatment object M, cooling can still be performed under a condition where pearlite structure which hardens the steel material and causes the steel material to become brittle is not formed, and a high-quality treatment object M is able to be obtained.

Note that fluorine-based inert liquids can be favorably used as the cooling liquid in the above described embodiment.

When a fluorine-based inert liquid is used, it is possible to prevent any adverse effects on the treatment object M without infringing on the constituent material of the treatment object M. Moreover, because fluorine-based inert liquids are non-flammable, safety can also be improved. Furthermore, because fluorine-based inert liquids have a higher boiling point than water, they have a greater cooling potential, and problems such as oxidation and vapor films and the like that occur when water is used can also be controlled. In addition to this, they also have superior heat transfer capabilities with regard to the latent heat of vaporization, and are able to efficiently cool a treatment object M. Furthermore, productivity is also improved as it is not necessary to wash of a fluorine-based inert liquid even if it sticks to the treatment object M.

A preferred embodiment of the present invention has been described above with reference made to the attached drawings, however, the present invention is not limited to this example. The various configurations and combinations and the like of the respective component elements illustrated in the above-described example are simply examples thereof, and various modifications may be made based on design requirements and the like insofar as they do not depart from the scope of the present invention.

For example, in the above described embodiment, the supply of cooling liquid in mist form is halted in the second step, however, the present invention is not limited thereto; and it is also possible to continue supplying cooling liquid mist in the second step provided that the density is lower than the mist density of the cooling liquid supplied in the first step.

The mist density may be adjusted by adjusting the cooling liquid supply quantity using the aforementioned motor 39 and pump 38, or by adjusting the supply pressure, or by adjusting the supply time (i.e., by performing frequency adjustment using a throttle valve or the like). In any of these cases, the first and second mist densities can be suitably set in accordance with their ability to cool the treatment object M.

Moreover, in the above described embodiment, the quantities of cooling liquid (mist) supplied from the plurality of nozzle portions 34 are uniform, however, the present invention is not limited thereto; and it is also possible to vary the supply quantities and the like in accordance with temperature measurement results. For example, a supply system may be constructed that is capable of controlling the supply quantity individually in each of the four supply pipes 32, and the supply quantity increased or decreased in each individual supply pipe 32 in accordance with the temperature measurement results. It is also possible for a shut-off valve to be provided in each nozzle portion 34, and for these to be used to adjust the supply quantity to each nozzle portion 34.

Moreover, in the above described embodiment, the temperature of the treatment object M is measured using the temperature sensors 80A and 80B, and the first step and second step are performed alternatingly in accordance with the measured temperature differences. However, it is also possible to switch between the first step and second step in accordance with a representational temperature of the treatment object M or a mean value of the measured temperature.

Furthermore, instead of switching between steps while the temperature of the treatment object M is being measured, it is also possible, for example, to tabulate correlations between the supply of cooling liquid in mist form and the temperature (i.e., cooling characteristics) of the treatment object M by performing experiments or simulations and the like in advance, and to then operate a timer while adjusting the supply of cooling liquid based on these correlations.

Figure 6:
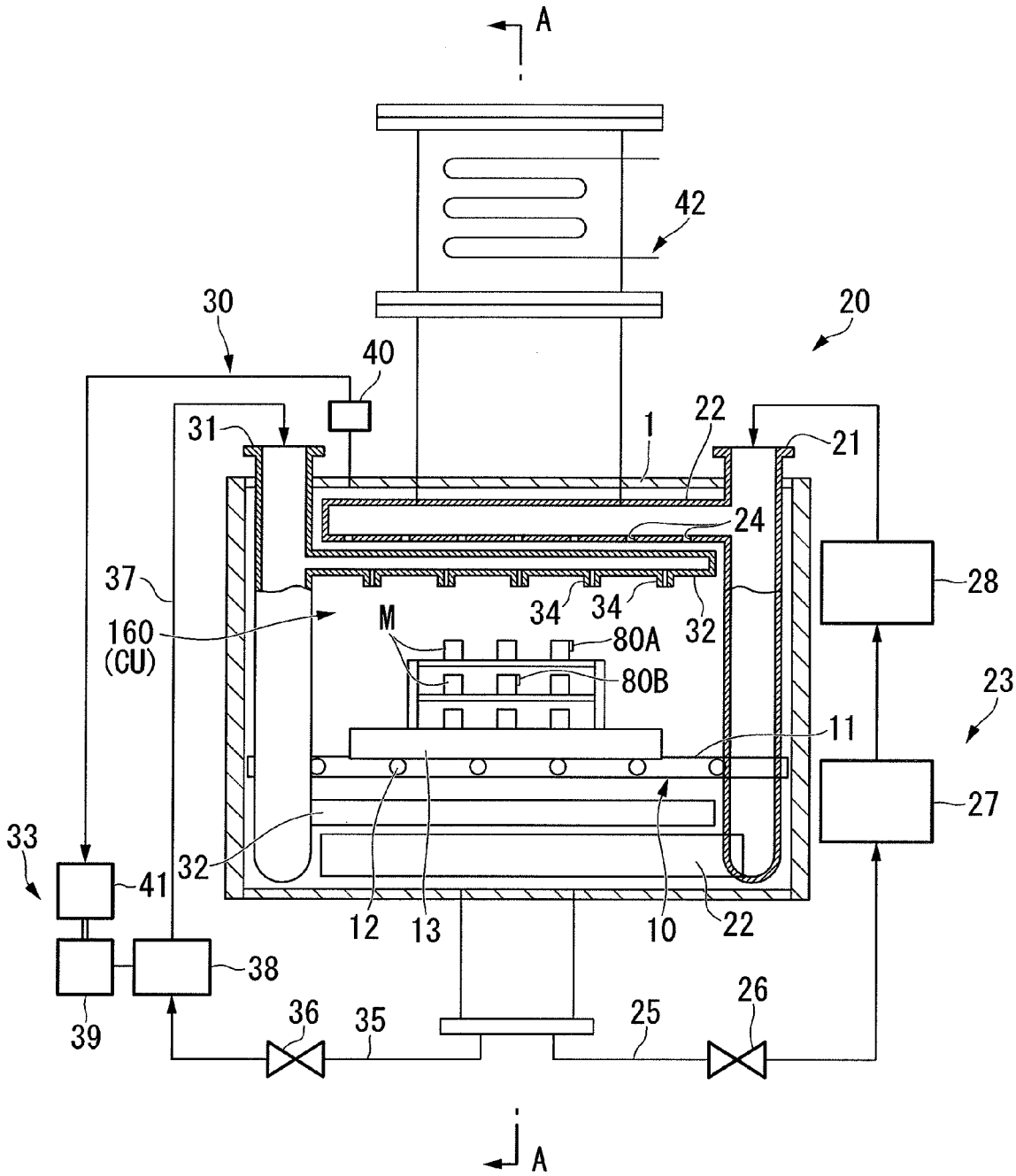
FIG. 6 is a front cross-sectional view of the cooling chamber when a plurality of treatment objects is being cooled.

Moreover, in the above described embodiment, temperature differences are determined by measuring the temperature in a plurality of locations in a single treatment object M, however, as is shown in FIG. 6, for example, the present invention can also be applied in cases in which cooling treatment is performed on a plurality of treatment objects M which are supported on trestles 15.

In this case, the temperature sensor 80A is provided on the treatment object M out of the plurality of treatment objects M that is positioned where the mist density is greatest (for example, at an outside position), and the temperature sensor 80B is provided on the treatment object M that is positioned where the mist density is smallest (for example, at an inside position), and, as is described above, the first and second steps may be switched in accordance with temperature differences measured by these temperature sensors 80A and 80B.

By doing this, in the present invention, it is possible to control temperature differences between a plurality of treatment objects M, and to limit the occurrence of quality defects in each of the treatment objects.

Moreover, the supplying of cooling liquid in the above described embodiment is normally conducted in a vacuum, however, it is also possible for the above described inert gas to be added, for example, during the mist cooling.

Normally, if the atmospheric pressure is high, the boiling point rises, while of the atmospheric pressure is low, the boiling point drops. Because of this, by adjusting the quantity of added inert gas so as to raise the atmospheric pressure, it is possible to improve the cooling capability by means of the latent heat of vaporization from the cooling liquid, and, conversely, by lowering the atmospheric pressure, the boiling point is lowered so that the temperature difference with the temperature of the supply liquid is narrowed and cooling speed (i.e., cooling performance) can be controlled.

In this manner, by adjusting the quantity of added inert gas, it is possible to control the cooling performance for the treatment object M, and more accurate cooling can be achieved.

Moreover, in the above described embodiment, the mist cooling apparatus 30 and the gas cooling apparatus 20 are used in combination with each other, however, the present invention is not limited to this and it is also possible to only provide the mist cooling apparatus 30.

Moreover, in the above described embodiment, oil, salt, and fluorine-based inert gas have been used as examples of cooling liquids, however, in addition to these, it is also possible to use water if the effects from oxidation and vapor films and the like are negligible. If water is used as the cooling liquid mist, then, using the same principle as that when the fluorine-based inert liquid is used, it is preferable for treatment to be performed under conditions ranging approximately between a controlled atmospheric pressure of 70 kPa (abs), at which the boiling point is 90° C., and a controlled atmospheric pressure of 48 kPa (abs), at which the boiling point is 80° C.

If water is used as the cooling liquid, then irrespective of whether it is in a liquid phase or a vapor phase, it can be expelled safely without any complex post-processing being necessary. This is clearly favorable from the standpoints of the costs incurred by post-processing and protecting the environment.

INDUSTRIAL APPLICABILITY

According to the heat treatment apparatus and heat treatment method of the present invention, it is possible to control temperature distribution during cooling, and it is possible to avoid the creation of quality defects such as deformation and unevenness in hardness.

DESCRIPTION OF THE REFERENCE NUMERALS

20 . . . Gas cooling apparatus, 30 . . . Mist cooling apparatus, 32 . . . Supply pipe (pipe body), 34 . . . Nozzle portions, 41 . . . Inverter (switching apparatus), 80 . . . temperature measuring apparatus, 100 . . . Vacuum heat treatment furnace (heat treatment apparatus), 160 . . . Cooling chamber, CU . . . Cooling unit, M . . . Treatment object, K1 . . . First step, K2 . . . Second step

What is claimed is:

1. A heat treatment method comprising:

a cooling step in which a cooling liquid in mist form is supplied to a treatment object which has been heated and transported into a cooling chamber, the cooling liquid reaches the treatment object and vaporizes, and the treatment object is cooled by depriving the treatment object of heat corresponding to latent heat of vaporization of the cooling liquid; and an atmospheric pressure-controlling step in which an atmospheric pressure in the cooling chamber is controlled based on a temperature at which the cooling liquid in mist form is supplied into the cooling chamber, the temperature being lower than a boiling point of the cooling liquid, so that a temperature difference between the temperature at which the cooling liquid in mist form is supplied and the boiling point of the cooling liquid becomes constant;

wherein the cooling chamber is formed inside a vacuum vessel that is configured to permit varying the atmospheric pressure in the cooling chamber by a gas supplied from outside the cooling chamber or expelling gas from the cooling chamber, and wherein the cooling step includes alternately repeating a first step in which the treatment object is cooled at a first mist density and a second step in which the treatment object is cooled at a second mist density that is less dense than the first mist density.

2. The heat treatment method according to claim 1, further comprising:

supplying the cooling liquid in mist form in the first step, and stopping the supplying of the cooling liquid in mist form in the second step.

3. The heat treatment method according to claim 1, further comprising:

adjusting a density of the cooling liquid in mist form using at least one of a supply quantity, a supply pressure, and a supply time of the cooling liquid.

4. The heat treatment method according to claim 1, further comprising:

storing a table showing correlations between a supply of the cooling liquid in mist form and temperature characteristics of the treatment object, and switching the treatment between the first step and the second step based on a temperature of the treatment object obtained from the supply of the cooling liquid in mist form and from the table.

5. The heat treatment method according to claim 1, further comprising:

measuring a temperature of the treatment object; and controlling supplying of the cooling liquid in mist form based on the measured temperature.

6. The heat treatment method according to claim 5, further comprising:

measuring temperatures of parts of the treatment object, and switching the treatment between the first step and the second step based on a temperature difference between the temperatures of the parts.

7. The heat treatment method according to claim 5, further comprising:

measuring temperatures of a plurality of treatment objects, and switching the treatment between the first step and the second step based on a temperature difference between the temperatures of the plurality of treatment objects.

8. A heat treatment apparatus that supplies a cooling liquid in mist form into a cooling chamber, and cools a heated treatment object, comprising:

a mist cooling apparatus configured to supply a cooling liquid in mist form to a treatment object which has been heated and transported into a cooling chamber, configured to allow the cooling liquid to reach the treatment object and to vaporize, and configured to cool the treatment object by depriving the treatment object of heat corresponding to latent heat of vaporization of the cooling liquid;

an atmospheric pressure-controlling apparatus configured to control an atmospheric pressure in the cooling chamber based on a temperature at which the cooling liquid in mist form is supplied into the cooling chamber, the temperature being lower than a boiling point of the cooling liquid, so that a temperature difference between the temperature at which the cooling liquid in mist form is supplied and the boiling point of the cooling liquid becomes constant; and a switching apparatus that switches supply of the cooling liquid in mist form alternately between a first mist density and a second mist density that is less than the first mist density, wherein the cooling chamber is formed inside a vacuum vessel that is configured to permit varying the atmospheric pressure in the cooling chamber by a gas supplied from outside the cooling chamber or expelling gas from the cooling chamber.

* * * * *